US009440820B2

(12) United States Patent
Sullivan et al.

(10) Patent No.: US 9,440,820 B2
(45) Date of Patent: Sep. 13, 2016

(54) ESCALATOR LIFTING FRAME AND METHOD OF USING THE SAME

(71) Applicant: KONE CORPORATION, Helsinki (FI)

(72) Inventors: Daniel Sullivan, Portland, CT (US); Richard M McCartin, Baldwin Place, NY (US)

(73) Assignee: Kone Coporation, Helsinki (FI)

( * ) Notice: Subject to any disclaimer, the term of this patent is extended or adjusted under 35 U.S.C. 154(b) by 0 days.

(21) Appl. No.: 14/593,960

(22) Filed: Jan. 9, 2015

(65) Prior Publication Data

US 2016/0200552 A1 Jul. 14, 2016

(51) Int. Cl.

*B66B 21/02* (2006.01)
*B66B 21/00* (2006.01)
*B66B 31/00* (2006.01)

(52) U.S. Cl.

CPC ..... *B66B 21/00* (2013.01); *B66B 31/00* (2013.01)

(58) Field of Classification Search

CPC ..... B66B 21/00; B66B 31/00; B66B 23/00; B66B 21/02; B66B 19/007; B66B 5/0025; B66B 5/0087; E04B 1/24

USPC ..... 52/143, 741.1, 126.1, 749.1; 248/688; 198/300, 308.1, 326; 180/6.62

See application file for complete search history.

(56) References Cited

U.S. PATENT DOCUMENTS 4,231,709 A * 11/1980 Corsetti ..... B60P 3/40 280/404
4,260,318 A * 4/1981 Holritz ..... B66B 21/02 254/3 R
5,779,255 A * 7/1998 Garcia, Jr. ..... B66F 3/02 280/404
6,105,748 A * 8/2000 Pallinger ..... B66B 23/00 198/321
6,129,198 A * 10/2000 Nusime ..... B66B 23/00 198/321
6,247,574 B1 * 6/2001 Yamaguchi ..... B66B 21/00 198/326
6,808,057 B1 * 10/2004 Nirmal ..... B64F 1/315 198/300
7,308,968 B2 * 12/2007 Denison ..... A62B 1/02 182/42
8,011,682 B2 * 9/2011 Klein ..... B66B 31/00 198/326
8,740,189 B2 6/2014 Klein et al.
2007/0216133 A1 * 9/2007 Klein ..... B66B 31/00 280/404
2014/0326577 A1 * 11/2014 Inoue ..... B66B 23/14 198/326

FOREIGN PATENT DOCUMENTS

CN 202988657 U 12/2012
EP 1795489 A1 12/2005
JP 2011-241078 A 5/2010

* cited by examiner

*Primary Examiner* — Beth Stephan
(74) *Attorney, Agent, or Firm* — Birch, Stewart, Kolasch & Birch, LLP

(57) ABSTRACT

A method is provided for removing an escalator truss from an escalator well-way having an upper landing and a lower landing, the escalator truss having a first end and a second end. The method includes placing a first forklift below the first end of the escalator truss under the upper landing, placing a second forklift at a second end of the escalator truss, lifting a lifting frame with the first forklift into contact with the first end of the escalator truss, connecting the first end of the escalator truss to the lifting frame, connecting the second forklift to the second end of the escalator truss with a lifting mechanism, raising both the first end and the second end of the escalator truss with the forklifts and moving both forklifts in a same direction to move the escalator truss away from the escalator well-way. A method of installing an escalator truss and lifting frame are also provided.

12 Claims, 7 Drawing Sheets

ESCALATOR LIFTING FRAME AND METHOD OF USING THE SAME

BACKGROUND OF THE INVENTION

1. Field of the Invention

The present application is directed generally to a method and device for installing/removing an escalator truss and, more particularly, to a method using a lifting frame and the lifting frame for installing/removing an escalator truss.

2. Description of Related Art

Escalators are used in many kinds of building, including commercial buildings, and in transportation terminals to move people quickly and efficiently from one floor to another. Escalator systems are designed to remain in use for many years. Often, the escalators are designed at the same time as the building and are built to fit the design of the building. However, occasionally, escalators need to be modernized or repaired. Depending on the location and size of an escalator, the option for removing the escalator can be limited. Traditionally, escalators are removed from an escalator well-way using A-Frames, 10K shoring or Low Deck cranes.

When an escalator is removed using A-Frames, the A-Frames are placed at both the top and bottom of the escalator well-way and then chain hoists are used to lift the escalator up, move it forward slightly, and then lower it to the lower landing. At that time, the escalator will be placed on rollable dollies for removal from the building. Due to the weight of the escalator truss and the A-Frames, problems can occur if the flooring that the escalator truss and A-frames are located on is not strong enough to support them.

Another form of escalator removal, known as 10K shoring uses scaffold towers and a steel beam to remove the escalator. A tower is erected at ground level on both sides of the escalator adjacent the top landing. A steel beam is placed across the two towers spanning the escalator and a chain hoist connected to the beam is used to lift and then lower the top of the escalator. The bottom of the escalator requires an a-frame with castors to lift the lower end. This method is time consuming and has its own risks.

Yet another approach to removing an escalator uses a low deck crane, which can be driven into the site of the escalator, to raise and then lower the top end of the escalator. If space allows, two cranes can be brought in and attached to the upper and lower ends of the escalator truss. The escalator is lifted out of the escalator well-way and set on dollies for removal from the building. Due to the size of the cranes, relative to the buildings/transportation terminals, this method has very limited use.

In addition, due to the various size constraints and other issues with the foregoing approaches, these methods also require the dismantling of the existing escalator in order to reduce the weight being lifted out. This also takes time and requires handling the removed material multiple times to get it out of the building and into a truck for disposal.

BRIEF SUMMARY OF THE INVENTION

According to principles of this invention, the present invention enables removal of old escalator trusses and installation of new trusses without the use of large cranes or extensive rigging at the upper and lower landings of the escalator to remove/install trusses at the escalator well-way.

According to one aspect of the present invention, a method is provided for removing an escalator truss from an escalator well-way having an upper landing and a lower landing the escalator truss having a first end connected to the upper landing and a second end connected to the lower landing. The method includes placing a first forklift below the first end of the escalator truss under the upper landing, placing a second forklift at a second end of the escalator truss, lifting a lifting frame with the first forklift into contact with the first end of the escalator truss, connecting the first end of the escalator truss to the lifting frame, connecting the second forklift to the second end of the escalator truss with a lifting mechanism, raising both the first end and the second end of the escalator truss with the forklifts and moving both forklifts in a same direction to move the escalator truss away from the escalator well-way.

According to another aspect of the present invention, a method is provided for installing an escalator truss in an escalator well-way having an upper landing and a lower landing, the escalator truss having a first end to be connected to the upper landing and a second end to be connected to the lower landing. The method includes connecting the first end of the escalator truss to the lifting frame, connecting the second forklift to the second end of the escalator truss with a lifting mechanism, raising both the first end and the second end of the escalator truss with the forklifts, moving both forklifts in a same direction to move the escalator truss towards the escalator well-way and lifting the lifting frame with the first forklift to align the first end of the escalator truss with the upper landing.

According to another aspect of the present invention, a lifting frame for lifting and lowering an end of an escalator truss is provided. The lifting includes a base, at least one member extending vertically from the base, the at least one vertical member having a first end at the base and a second end distal from the base, a hinge located at the second end of the at least one vertical member and a truss support connected to the hinge, the truss support being pivotable with respect to the base, the truss support including a planar portion connected to the hinge and an upright portion connected to the planar portion.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1A:
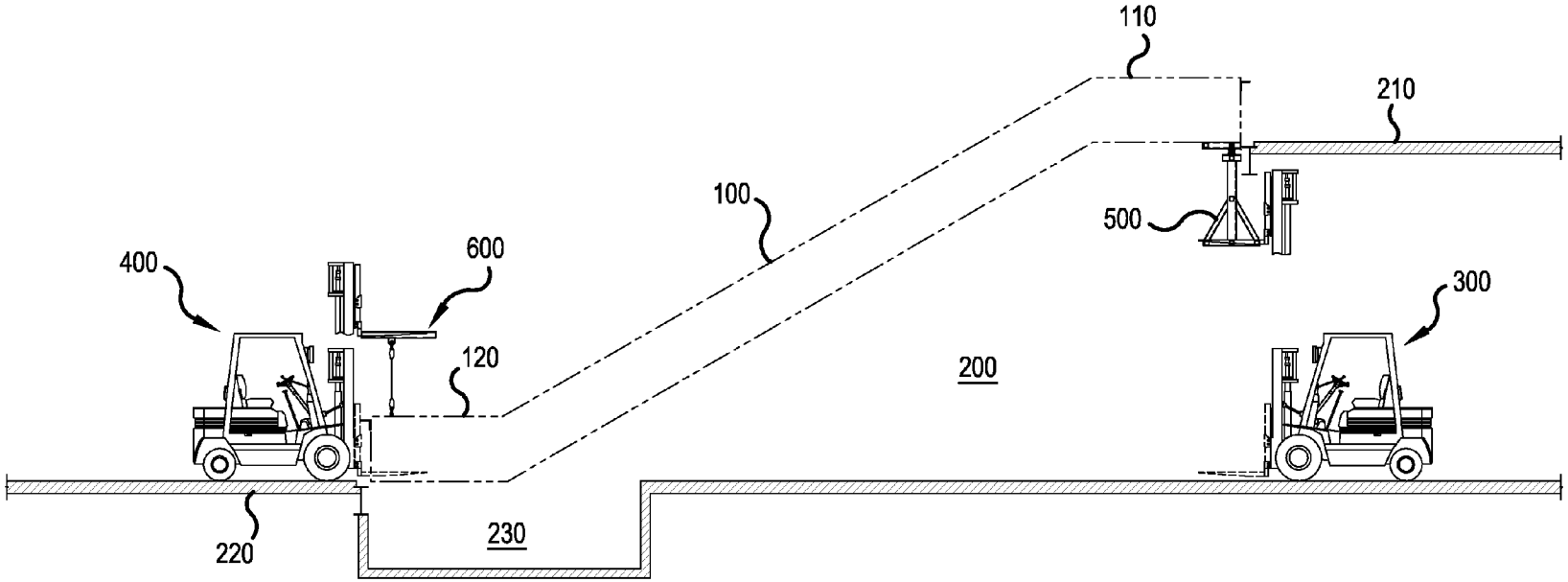
FIGS. 1A to 1C are diagrams showing a method of installing/removing an escalator truss according to an embodiment of the present invention.

For purposes of the present application, the term escalator is considered to include applications that provide moving stairs as well as applications that provide an inclined, moving walkway. Generally, trusses for both moving stairs and inclined, moving walkways are similar in configuration and connection to support structures. Referring now to the drawings, wherein like reference numerals designate identical or corresponding parts throughout the several views, a method of removing/installing an escalator truss using a lifting frame is provided. The method and lifting frame are provided in such a manner that it is possible to remove an escalator truss from an escalator well-way without the need to dismantle the entire truss.

Prior to removing the escalator truss, the exterior cladding, which may be metal or sheetrock, sprinklers, and electrical power piping and wiring will be removed. The top and bottom ends of the escalator truss, which generally will be encased in poured concrete, are chopped free for extraction of the escalator truss. Once the escalator truss is freed from the building structure, the method and lifting frame can be employed. An exemplary method of removing an escalator truss will be described with reference to FIGS. 1A-1C.

Figure 1B:
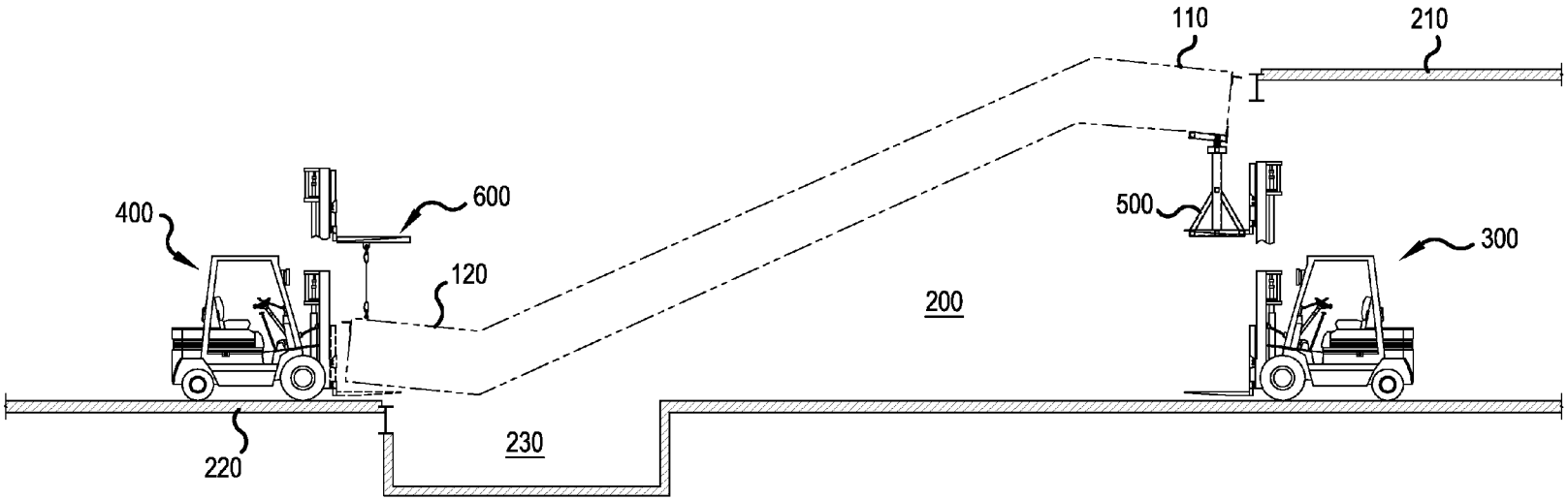
Figure 1C:
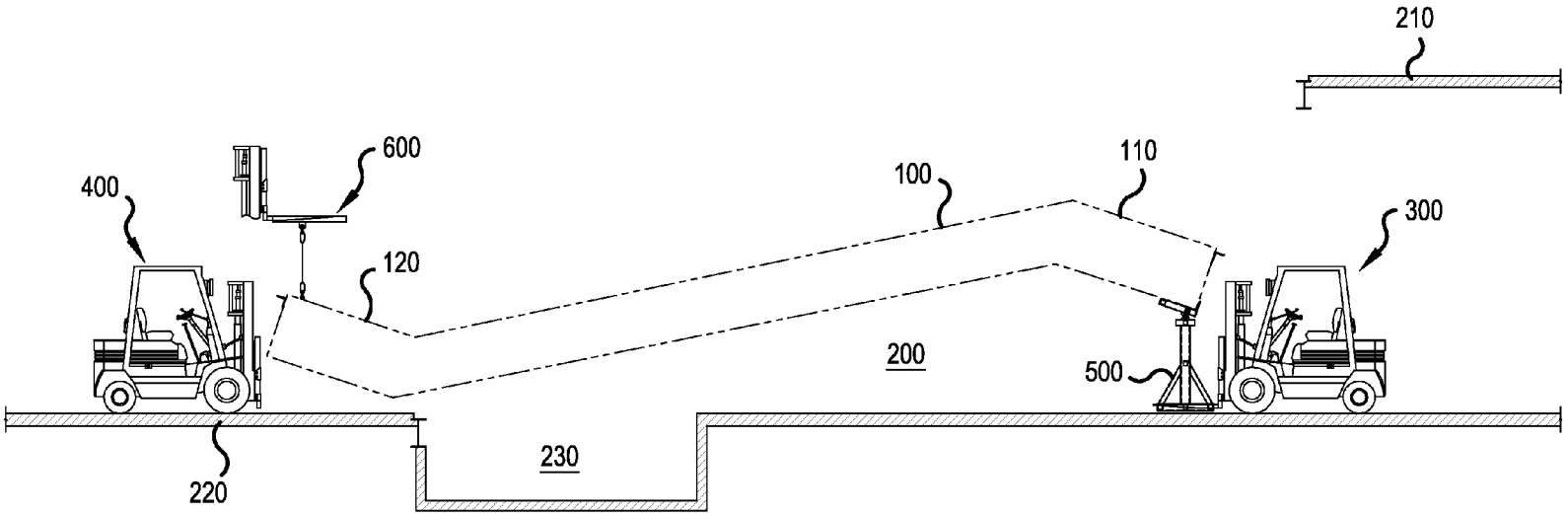

As shown in FIGS. 1A-1C thereof, a method of removing an escalator truss 100 from an escalator well-way 200 having an upper landing 210 and a lower landing 220 is demonstrated. In this the arrangement, the escalator truss 100 has a first end 110 connected to the upper landing 210 and a second end 120 connected to the lower landing 220.

Referring to FIG. 1A, a first forklift 300 can be placed or located below the first end 110 of the escalator truss 100 under the upper landing 210 while a second forklift 400 can be placed or located at the second end 120 of the escalator truss 100. A lifting frame 500 can be lifted by the first forklift 300 into contact with the first end 110 of the escalator truss 100. For example, the lifting frame 500 can be brought into contact with a lowermost horizontal frame member of the escalator truss 100.

Once in position, the first end 110 of the escalator truss 100 can be connected to/secured to the lifting frame 500 by ratchet straps or other suitable securing mechanisms. Meanwhile, the second end 120 of the escalator truss 100 can be connected to/supported by a lifting mechanism 600. In this exemplary embodiment, the lifting mechanism 600 is a chain hoist. After connecting/securing both ends 110, 120 of the escalator truss 100, both ends 110, 120 are raised by lifting the forks of the forklifts 300, 400, thereby raising both ends 110, 120 to clear the upper landing 210 and lower landing 220. Depending on the installation of the escalator in the well-way 200, the second end 120 of the escalator truss 100 should be raised a sufficient height so that the second end 120 can clear the escalator pit 230. Preferably, both ends 110, 120 of the escalator truss 100 are lifted to avoid jamming the escalator truss 100 in the escalator well-way 200.

Referring to FIG. 1B, once both ends 110, 120 of the escalator truss are clear of the landings, both forklifts 300, 400 are moved in the same direction to move the escalator truss away from the escalator well-way 200. For example, the second end 120 of the escalator truss 100 is moved away from the escalator pit 230. While moving away from the escalator well-way 200, or after the escalator truss 100 has been moved clear of the escalator pit 230, the lifting frame 500 can be lowered. Preferably, the lifting frame 500 and lifting mechanism 600 are moved in tandem for a controlled lowering of the escalator truss 100.

Once the lifting frame 500 has been lowered to the ground, as shown in FIG. 1C, the first end 110 of the escalator truss 100 will remain supported by the lifting frame 500 and the second end 120 of the escalator truss 100 can remain supported by the lifting mechanism 600. In order to remove the first end 110 of the escalator truss 100, the first forklift 300 can backed out of the lifting frame 500, repositioned under the first end 110 of the escalator truss 100 and pick-up the first end 110 of the escalator truss 100 so that the lifting frame 500 can be withdrawn using a pallet jack or other suitable means.

Having removed the escalator truss 100 from the escalator well-way 200, the escalator truss 100 can be placed on dollies to be rolled out of the building or transportation terminal. Alternatively, the escalator truss 100 can be carried out of the building or transportation terminal using the forklifts 300, 400. It is understood that once the escalator truss 100 has been lowered to the ground, the escalator truss 100 can be removed from the building or transportation by moving/driving the escalator truss around the escalator pit 230.

Figure 5:
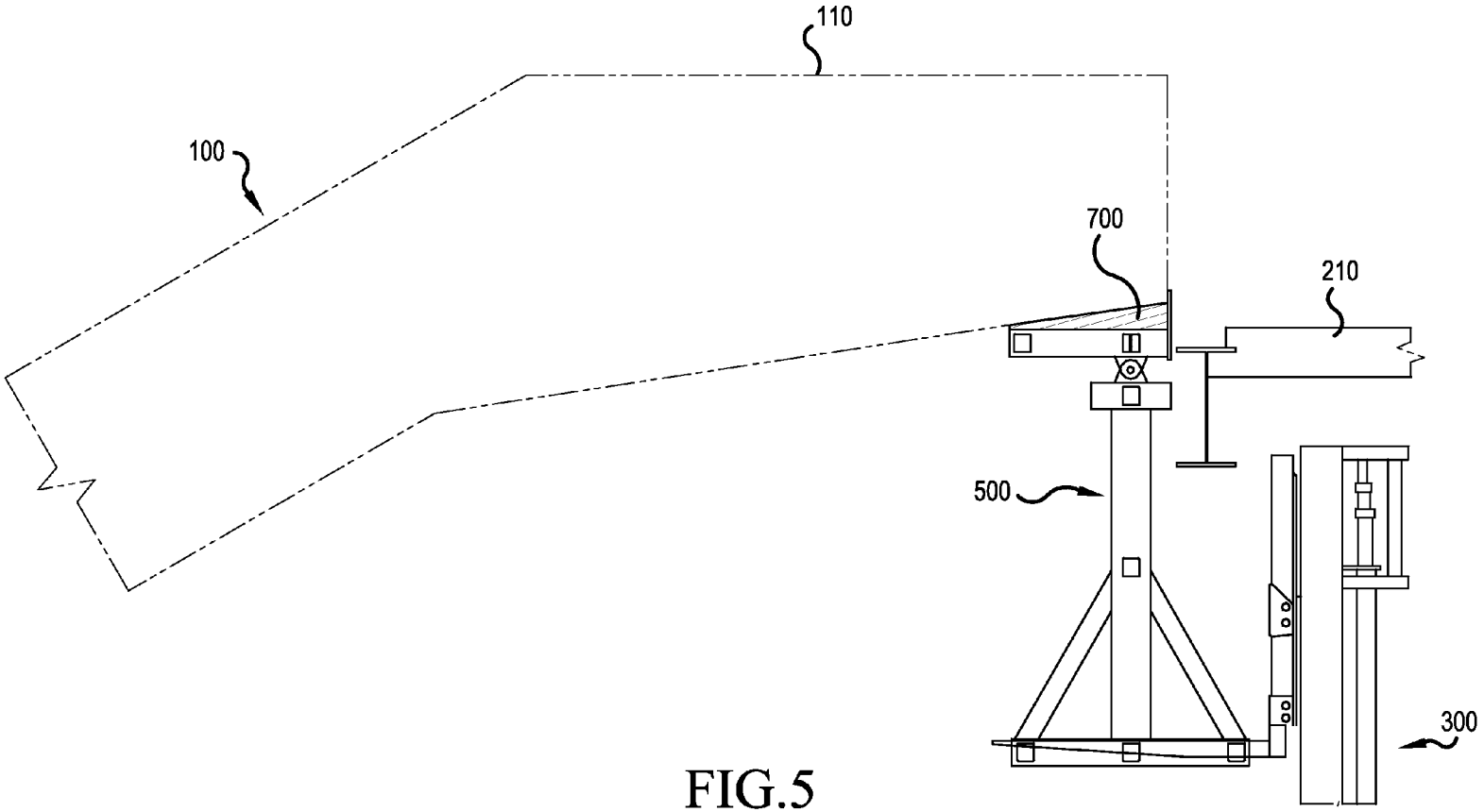
FIG. 5 is a partial view of the lifting frame used to lift an escalator truss according to another embodiment of the present invention.

As will be described in greater detail below, the lifting frame 500 may include a planar portion that is pivotable such that the planar portion rotates as the first end 110 of the escalator truss 100 is lowered. Depending on the shape of the first end 110 of the escalator truss 100, a wedge member 700 or other blocking may be provided so as to stably support the first end 110, particularly, if the first end 110 has a tapered, lower portion (see FIG. 5)

In this exemplary embodiment, three-stage forklifts can be used so that the forklifts can enter the building or transportation terminal while still being able to extend high enough to reach the first end 110 of the escalator truss.

Having described an exemplary method of removing an escalator truss 100, it is understood that the method could be reversed to install a new escalator truss 100 in the same location. For example, the method could include connecting a first end 110 of an escalator truss 100 to a lifting frame 500 supported by a first forklift 300, connecting a second forklift 400 to the second end of the escalator truss with a lifting mechanism 600, raising both ends 110, 120 of the escalator truss with the forklifts 300, 400, moving both forklifts 300, 400 in a same direction to move the escalator truss 100 towards an escalator well-way 200 and lifting the lifting frame 500 with the first forklift to align the first end 110 of the escalator truss with an upper landing 220. Once in place, the first end 110 of the escalator truss is connected to the upper landing 210 and the second end 120 of the escalator truss 100 is connected to the lower landing 220. If the escalator well-way 200 includes an escalator pit 230, the second end 120 of the escalator truss 100 is connected to the lower landing 220 after lowering the second end 120 of the escalator truss 100 into the escalator pit 230.

Figure 2:
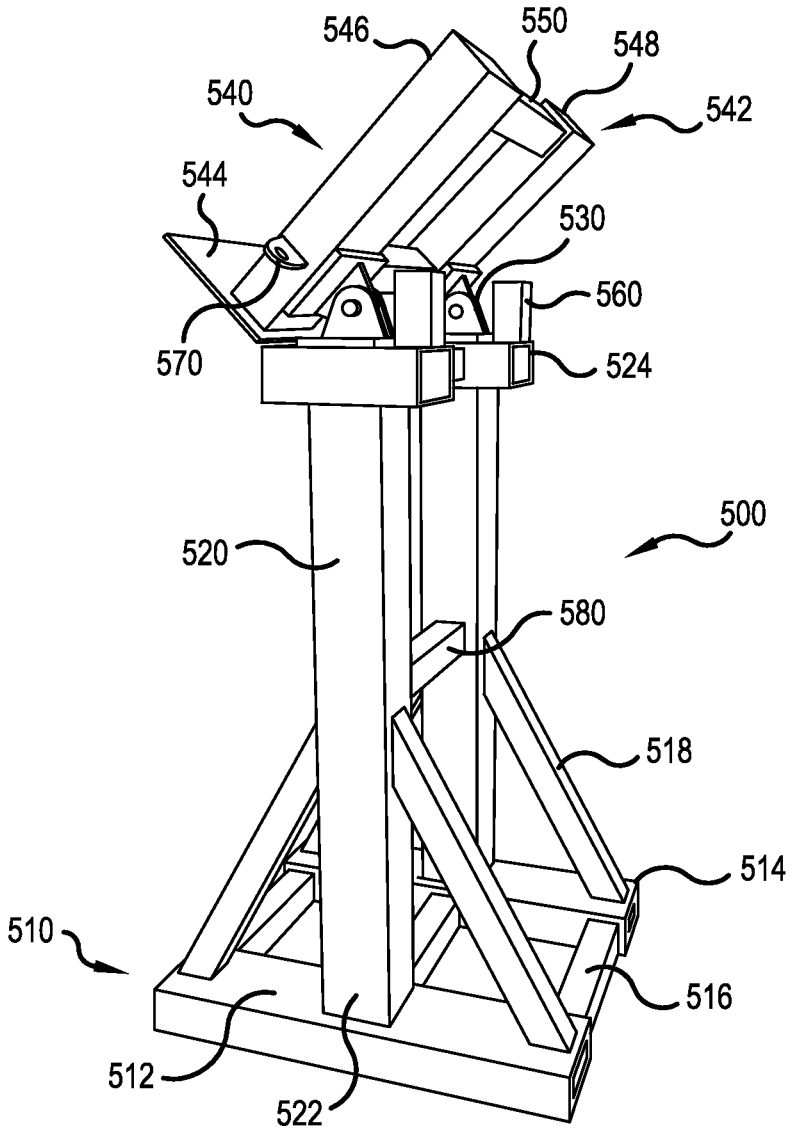
FIG. 2 is a perspective view of a lifting frame according to an embodiment of the present invention.
Figure 3:
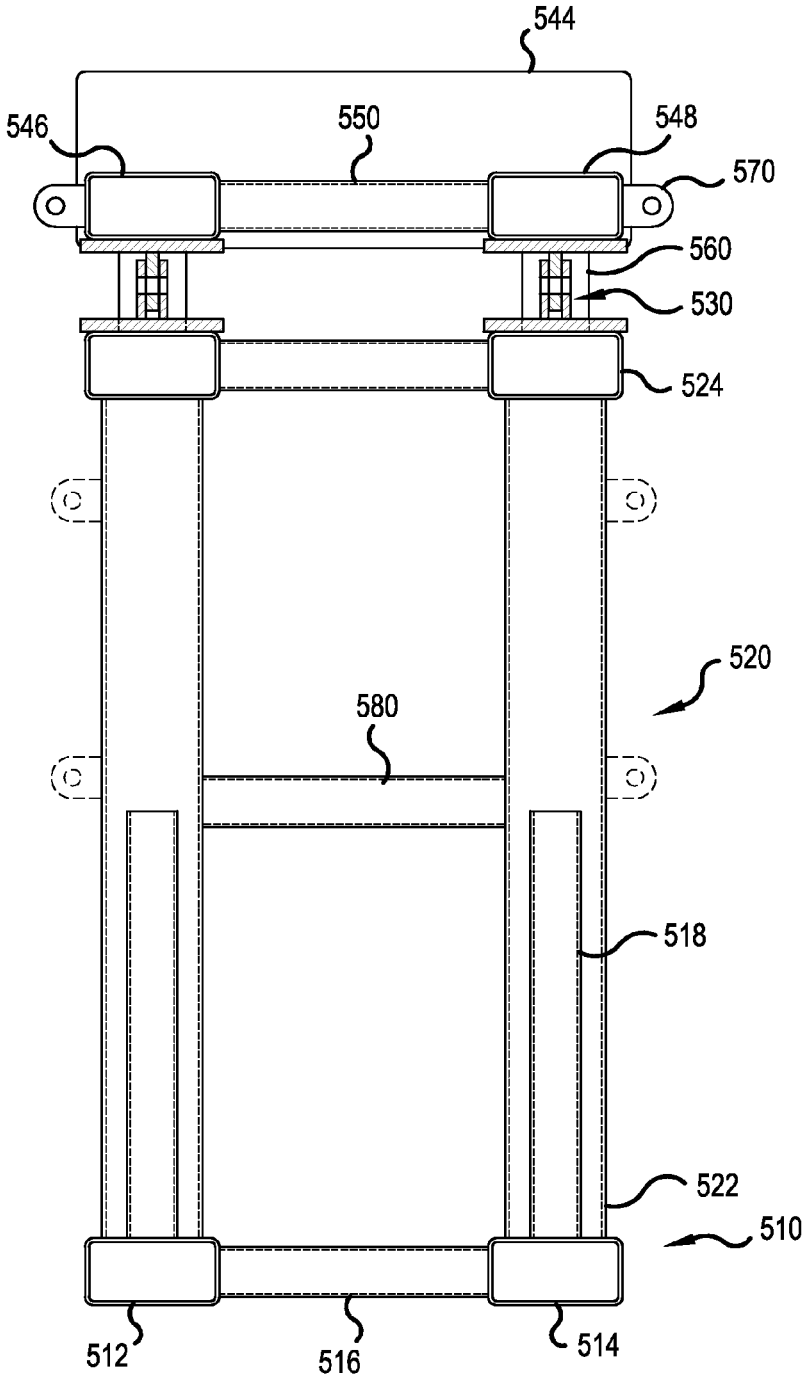
FIG. 3 is a side view of the lifting frame of FIG. 2.
Figure 4:
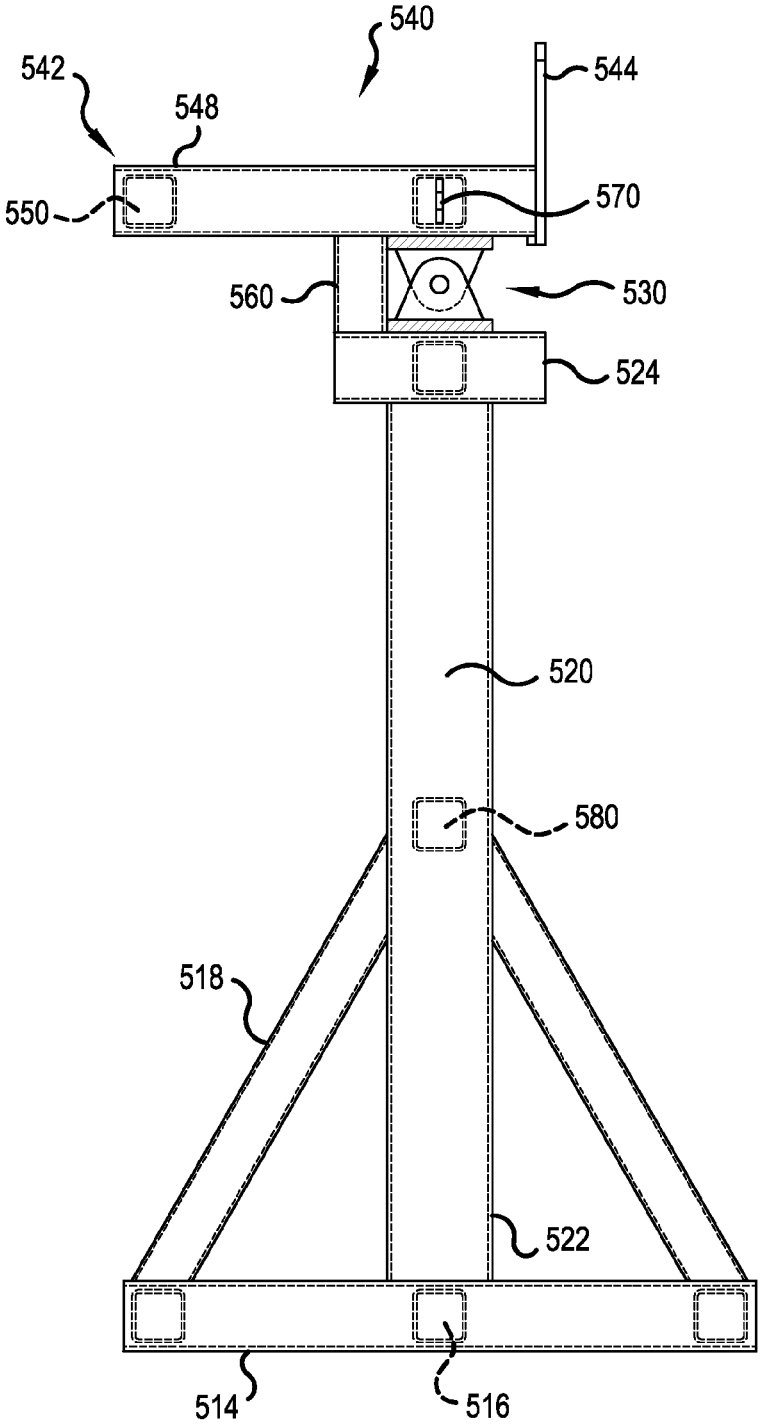
FIG. 4 is a front view of the lifting frame of FIG. 2.

Referring to FIGS. 2-4, an exemplary embodiment of the lifting frame 500 will now be described. As shown in these figures, the lifting frame 500 includes a base 510, two members 520 extending vertically from the base 510, where each vertical member 520 includes a first end 522 at the base 510 and a second end 524 distal from the base 510, a hinge 530 located at the second end 524 of each of the vertical members 520 and a truss support 540 connected to the hinges 530 where the truss support 540 is pivotable with respect to the base 510.

The base 510 includes a pair of hollow beams 512, 514 configured to cooperate with forks of a forklift to allow the lifting frame to be lifted by the fork lift. One or more additional beams or bracings 516 can be provided between the hollow beams 512, 514. Additional bracings 518 can be provided that extend between the base 510 and the vertical members 520 to provide additional structural integrity to the lifting frame 500.

The truss support 540 includes a planar portion 542 connected to the hinge 530 and an upright portion 544 connected to the planar portion 542. The upright portion 544 prevents an end of the escalator truss from sliding off of the planar portion when being raised and lowered. In this exemplary embodiment, the planar portion 542 includes a pair of spaced apart beams 546, 548 whereby each of the beams 546, 548 has a first end connected to the upright portion 544 and a second end distal from the upright portion and connected by another beam or bracing 550. The additional beam or bracing 550 helps maintain the structural integrity of the planar portion 542.

Anchor points 570 may be provided to each of the beams 546, 548 to receive straps for securing a portion of an escalator truss to the planar portion. By providing both anchor points 570 and the upright portion 544, a portion of the escalator truss can be reliably connected to the planar portion 542 during lifting and lowering. It is understood that the anchor points could be provided at different/additional locations on the lifting frame 500, such as, for example, on the vertical members 520.

The lifting frame 500 also includes a stop member 560 at the second end 524 of each of the vertical members 520. The stop member 560 assists in restricting rotation of the truss support 540 during use of the lifting frame 500. Additional beams 580 can be provided between vertical members 520 to provide additional structural integrity to the lifting frame 500.

Generally, the foregoing methods and lifting frame are useable for escalators that are installed on a ground floor as they provide ready access for a forklift and have the strength to support the weight of the forklifts plus the lifting frame and escalator truss. To the extent that other floors or levels have similar accessibility and strength, the methods and lifting frame could be used on those floors or levels as well. Because the forklifts are generally on the same level, the size of escalator trusses that are movable will be governed by reach of the forklifts and, preferably, with escalator trusses having rises of up to approximately eighteen feet.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of removing an escalator truss from an escalator well-way having an upper landing and a lower landing, the escalator truss having a first end connected to the upper landing and a second end connected to the lower landing, the method comprising the steps of:

placing a first forklift below the first end of the escalator truss under the upper landing;

placing a second forklift at the second end of the escalator truss;

lifting a lifting frame with the first forklift into contact with the first end of the escalator truss;

connecting the first end of the escalator truss to the lifting frame;

connecting the second forklift to the second end of the escalator truss with a lifting mechanism;

raising both the first end and the second end of the escalator truss with the forklifts; and moving both forklifts in a same direction to move the escalator truss away from the escalator well-way.

2. The method of claim 1, wherein raising both the first end and the second end of the escalator truss includes raising the first end of the escalator truss high enough to clear the upper landing.

3. The method of claim 1, wherein the escalator well-way includes an escalator pit, and wherein raising both the first end and the second end of the escalator truss includes raising the second end of the escalator truss high enough to clear the escalator pit.

4. The method of claim 3, wherein moving both forklifts in the same direction includes moving the second forklift away from the escalator pit.

5. The method of claim 1, wherein moving both forklifts in the same direction includes moving the second forklift away from the upper landing.

6. The method of claim 1, further comprising lowering the escalator truss to a floor having the lower landing by lowering the lifting frame with the first forklift.

7. The method of claim 6, wherein the lifting frame includes a planar portion that is pivotable such that the planar portion rotates as the first end of the escalator truss is lowered.

8. The method of claim 7, wherein, when the first end of the escalator truss has a tapered, lower portion, the method further includes using a wedge member between the planar portion and the first end of the escalator.

9. The method of claim 1, further comprising removing the lifting frame from beneath the first end of the escalator truss.

10. A method of installing an escalator truss in an escalator well-way having an upper landing and a lower landing, the escalator truss having a first end to be connected to the upper landing and a second end to be connected to the lower landing, the method comprising:

connecting the first end of the escalator truss to a lifting frame supported by a first forklift;

connecting a second forklift to the second end of the escalator truss with a lifting mechanism;

raising both the first end and the second end of the escalator truss with the forklifts;

moving both forklifts in a same direction to move the escalator truss towards the escalator well-way; and lifting the lifting frame with the first forklift to align the first end of the escalator truss with the upper landing.

11. The method of claim 10, further comprising:

connecting the first end of the escalator truss to the upper landing;

connecting the second end of the escalator truss to the lower landing.

12. The method of claim 11, wherein the escalator well-way includes an escalator pit, and wherein connecting the second end of the escalator truss to the lower landing includes lowering the second end of the escalator truss into the escalator pit.

* * * * *